United States Patent [19]

Rubenstein et al.

[11] Patent Number: 4,540,292

[45] Date of Patent: Sep. 10, 1985

[54] ELECTRONIC CALENDAR DISPLAY

[75] Inventors: Charles P. Rubenstein, Massapequa; Jeffrey S. Nevid, Bayside, both of N.Y.; Spencer A. Rathus, Princeton, N.J.

[73] Assignee: Psytronics Associates, Princeton, N.J.

[21] Appl. No.: 566,204

[22] Filed: Dec. 28, 1983

[51] Int. Cl.[3] ..... G04B 19/24; G04C 19/00

[52] U.S. Cl. ..... 368/29; 368/82

[58] Field of Search ..... 368/28–31, 368/82–84, 239–242; 40/107, 110

[56] References Cited

U.S. PATENT DOCUMENTS

| | | | |
|---|---|---|---|
| 3,738,099 | 6/1973 | Tanaka | 368/30 |
| 4,205,516 | 6/1980 | Terao . | |
| 4,214,433 | 7/1980 | Terao . | |
| 4,233,681 | 11/1980 | Murata | 368/242 |
| 4,270,192 | 5/1981 | Kudo | 368/29 |
| 4,274,146 | 6/1981 | Yanagawa . | |
| 4,303,995 | 12/1981 | Ailawa | 368/28 |
| 4,428,681 | 1/1984 | Kashio | 368/29 |

FOREIGN PATENT DOCUMENTS

| | | | |
|---|---|---|---|
| 53-90970 | 8/1978 | Japan | 368/30 |
| 53-140073 | 12/1978 | Japan | 368/28 |
| 56-100388 | 8/1981 | Japan | 368/29 |

*Primary Examiner*—Vit W. Miska

*Attorney, Agent, or Firm*—Ostrolenk, Faber, Gerb & Soffen

[57] ABSTRACT

An electronic calendar display in which each column always corresponds to a particular day of the week is disclosed. Each display element in each column includes a group of display segments which are selectively activated to display a number corresponding to a day of the month. Seven display elements are used to form a row representing a week, and six such rows may be arranged to represent an entire month. In addition, twelve month displays may be arranged to represent a year. The circuitry which updates the display segments includes a look-up table stored in a read-only memory which indicates the display segments to be activated for the current month and year. In the preferred embodiment, this circuitry also includes a microprocessor and the display includes alphanumeric display elements which can display a message. A keyboard or other interface permits an operator to enter the message. A watch is used to provide an indication of the current time and to signal when the display should be updated. In addition, the operator may push buttons to change the calendar data displayed.

35 Claims, 20 Drawing Figures

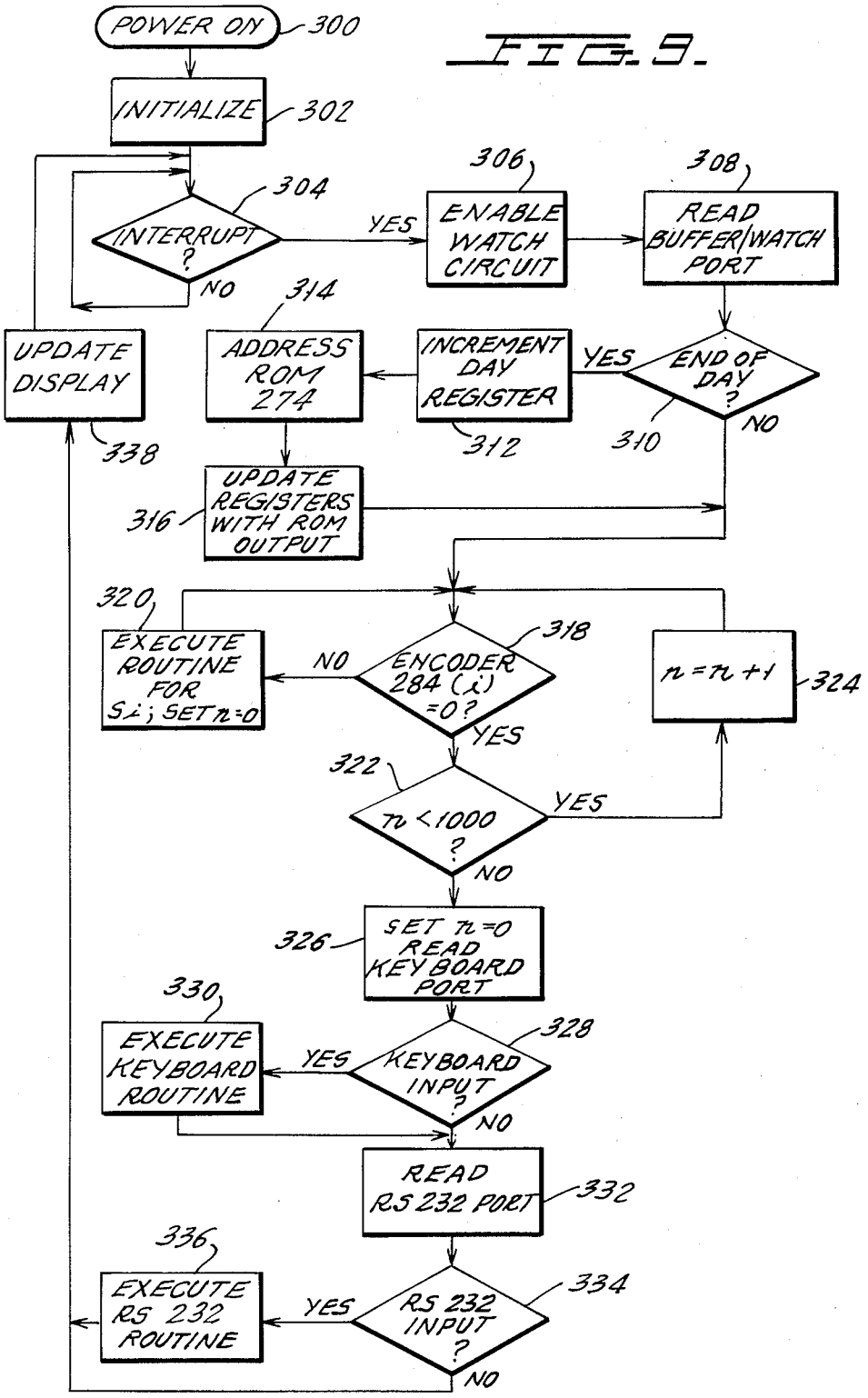
FIG. 9.
POWER ON
300
INITIALIZE
302
INTERRUPT ?
304
YES
NO
ENABLE WATCH CIRCUIT
306
READ BUFFER/WATCH PORT
308
END OF DAY ?
310
YES
NO
INCREMENT DAY REGISTER
312
ADDRESS ROM 274
314
UPDATE DISPLAY
338
UPDATE REGISTERS WITH ROM OUTPUT
316
ENCODER 284 (i) =0 ?
318
NO
YES
EXECUTE ROUTINE FOR Si; SET n=0
320
n=n+1
324
n<1000 ?
322
YES
NO
SET n=0 READ KEYBOARD PORT
326
KEYBOARD INPUT ?
328
YES
NO
EXECUTE KEYBOARD ROUTINE
330
READ RS 232 PORT
332
RS 232 INPUT ?
334
YES
NO
EXECUTE RS 232 ROUTINE
336

ELECTRONIC CALENDAR DISPLAY

BACKGROUND OF THE INVENTION

1. Field of the Invention

This invention relates to an electronic display which shows a calendar. More specifically, this invention relates to an electronic calendar display which indicates the numerical day, the day of the week, the month, and the year.

2. Description of the Prior Art

Electronic devices for displaying calendar data are known. Examples of such devices are the following U.S. Pat. Nos.: 4,303,995; 4,274,146; 4,270,192; 4,233,681; 4,214,433; and 4,205,516. Each of the foregoing patents discloses an electronic timepiece capable of displaying a full calendar month. The number of days in each month is revised on a month-by-month basis to indicate the actual number of days in the month being displayed. The position of the first day of each month is, however, not changed on a month-to-month basis. Thus, the dates corresponding to the Sundays of each month will not always appear in the leftmost column as with most standard calendars. Each patent provides an indication as to which column in the month corresponds to Sunday. For example, in U.S. Pat. No. 4,270,192, the abbreviation "Su" is placed above the appropriate column corresponding to the Sundays of that month. In an analogous manner, U.S. Pat. No. 4,214,433 illuminates one of a plurality of arrows to indicate the column corresponding to Sunday.

The primary drawback of the foregoing prior art devices is their inability to change the position of the days of the month so as to electronically duplicate a standard calendar configuration. This makes the calendars electronically displayed much more difficult to read and results in the fact that a full week (Sunday through Saturday) will normally appear in two different horizontal rows of the calendar. Similarly, an ordinary work week (Monday through Friday) will usually be split between two rows.

SUMMARY OF THE INVENTION

One object of this invention, therefore, is to provide an electronic calendar display arranged in the same manner as an ordinary printed calendar. More specifically, an object of this invention is to provide an electronic calendar display in which the days of each month are arranged in rows and columns, with each row being seven days long to represent a week which begins on the first day of the week and ends on the last day, and each column always corresponding to a particular day of the week. In other words, each column will include each day of the month which occurs on the corresponding day of the week. Furthermore, an object of this invention is to provide such an electronic calendar display in which the days of each ordinary work week are always shown in a single row.

A further object of this invention is to provide an electronic calendar display in which a look-up table may be used to obtain the information necessary for the correct operation of the display. More specifically, an object of this invention is to provide an electronic calendar display which can be used to display any particular month of any particular year, in any of several calendar systems.

A further object of the invention is to provide an electronic calendar display in conjunction with a watch. More specifically, an object of the invention is to provide a watch which signals when the calendar display should be automatically updated to indicate the current time, day, month or year.

These and other objects of the invention are achieved by arranging display elements into at least one row containing seven adjacent one-digit or two-digit numbers. This arrangement of display elements is combined with updating circuitry which selectively actuates display elements to display the numbers corresponding to days of the month in columns such that each column always corresponds to a particular day of the week. In one embodiment, the display elements are 7-segment displays. In another, the display elements are dot matrix displays, which may also display alphabetical characters.

In another preferred embodiment, the display includes five such rows of display elements and a sixth row including two separate two-digit numbers so that any month of 31 days or less, beginning on any day of the week, can be fully represented on the display. In this embodiment, the display also includes a group of display elements arranged to indicate which month and which year are being displayed, in response to the updating circuitry.

In another embodiment of the invention, 12 such displays of one month each are combined into a single display of an entire year. In this embodiment, a group of display elements are arranged to display the year in response to the updating circuitry.

In the preferred embodiment of the invention, the above-described display is combined with a time-keeping circuit, such as a watch, and with a display indicating the current time of day. The time-keeping circuit provides signals through the updating circuitry for automatically updating the display to indicate the current time, day, month and year.

The preferred embodiment of the invention also includes a selection circuit responsive to inputs from an operator. In response to such inputs, the time-keeping circuit may be adjusted to the correct time or the display may be caused to display a desired week, month or year for the purpose of providing information to the operator.

Also, the preferred embodiment of the invention includes a look-up table which stores information about each week, month or year to be displayed. In one embodiment, the look-up table can store information relating to a specific period of years in any of several calendar systems. In another embodiment, the look-up table stores a group of rules which may be employed by a processing circuit to determine how the display elements must be actuated to display a given week, month or year.

In the preferred embodiment of the invention, the updating circuit and selection circuit employ a programmed microprocessor.

In a further embodiment, a portion of the display also includes alphanumeric characters to permit the display of a memo message to the operator. In another embodiment, an input to the selection circuit permits the operator to change the display into any of several modes, including an alarm mode, stop watch mode and memo mode.

Other objects, features and advantages of the invention will be apparent from the following description, together with the accompanying drawings and the appended claims.

BRIEF DESCRIPTION OF THE DRAWINGS

For the purpose of illustrating the invention, the drawings show several forms which are presently preferred, it being understood, however, that this invention is not limited to the precise arrangements and instrumentalities shown.

FIG. 9 is a flow chart of the program for the microprocessor of FIG. 8.

DETAILED DESCRIPTION OF THE PREFERRED EMBODIMENTS

1. Overall Operation of the Invention

Figure 1:
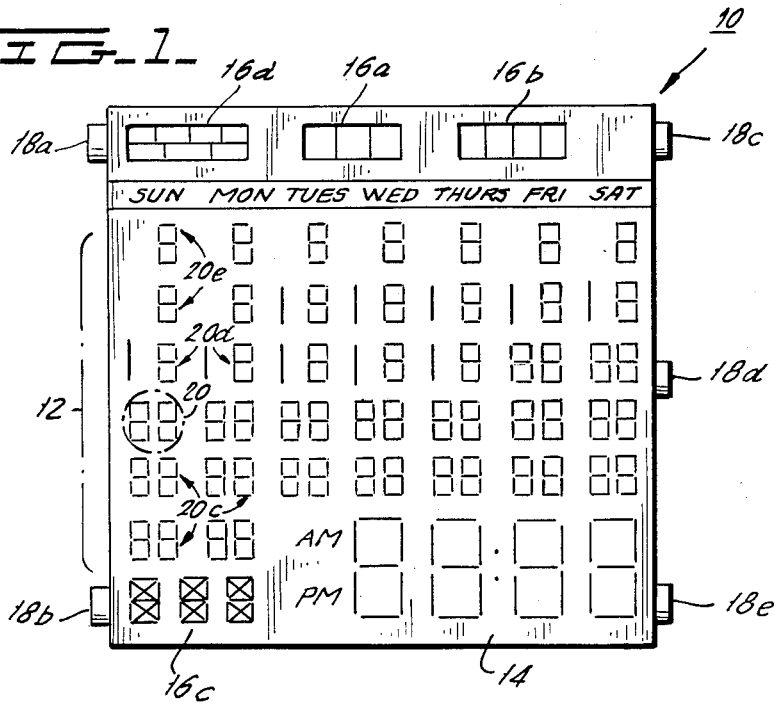
FIG. 1 is a side view of a first embodiment of the invention, capable of displaying one month of a calendar.
Figure 1C:
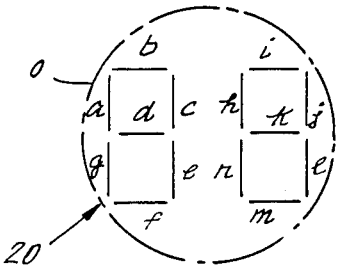
FIG. 1C is a detailed view of the display elements in the embodiment of FIG. 1.
Figure 1D:
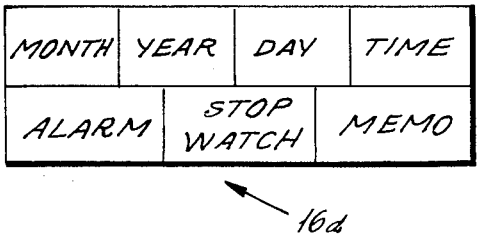
FIG. 1D is a detailed view of the select grid of the embodiment shown in FIG. 1.
Figure 1A:
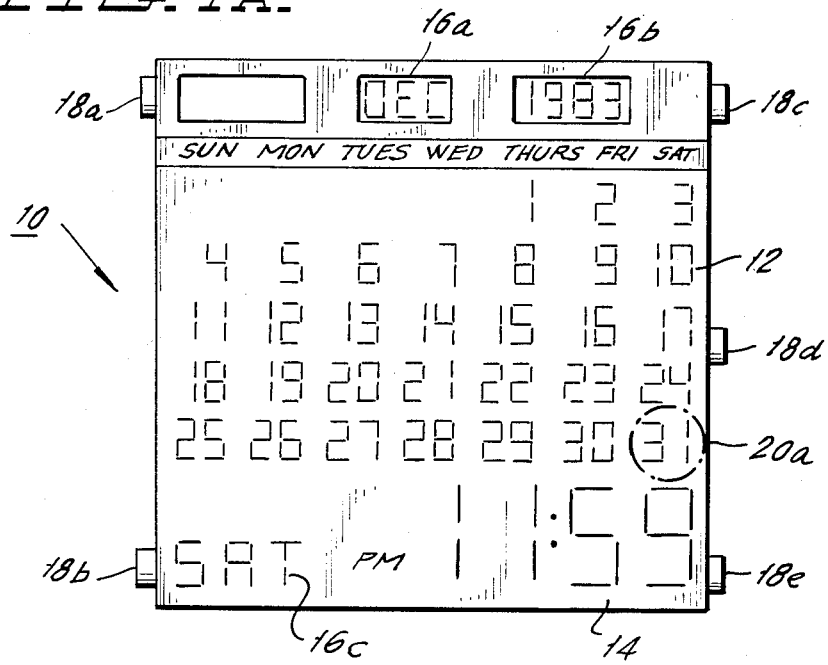
FIG. 1A is a schematic view of the display of FIG. 1 as it would appear on Dec. 31, 1983.
Figure 1B:
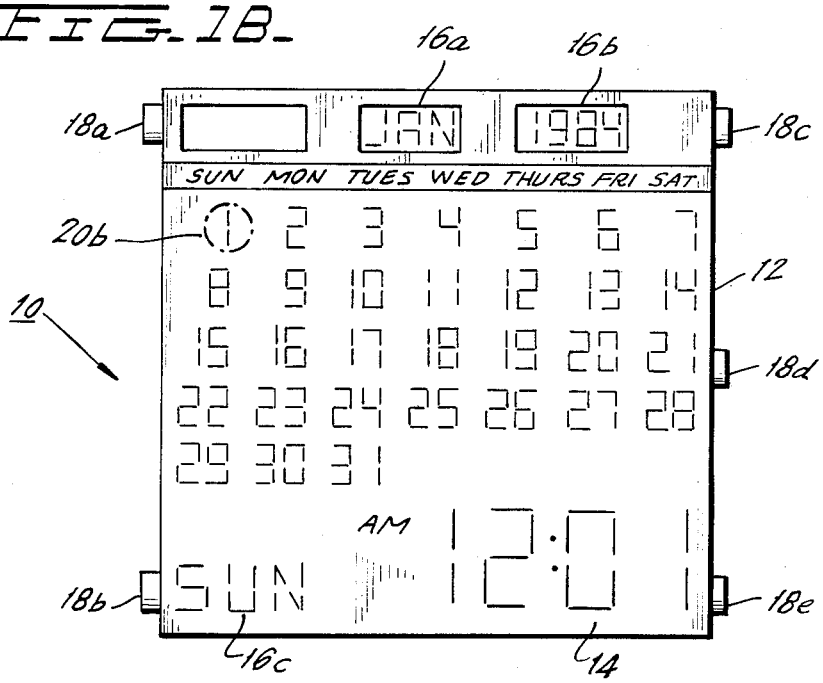
FIG. 1B is a schematic view of the display of FIG. 1 as it would appear on Jan. 1, 1984.

The overall operation of the electronic calendar display of the invention may be most easily understood by referring to FIGS. 1, 1A and 1B. FIG. 1 shows a month display 10 in which the numbers corresponding to the days of a month are displayed in six day display rows 12. FIGS. 1A and 1B show how month display 10 would appear on Dec. 31, 1983 and after being updated on Jan. 1, 1984, respectively. As shown in FIG. 1A, if the current month were December, 1983, which begins on Thursday, and has 31 days, the numbers 1–31 would be displayed, beginning with the Thursday in the uppermost row of the day display rows 12, and ending on the Saturday of the fifth row of the day display rows 12. In addition, if today were December 31, the fifth Saturday of the month, an indicator at the display element **20*a* on the right-hand side of the fifth row of the day display rows 12 would be activated, thus indicating today's date. In addition, the letters "DEC" would be displayed in month display 16*a*; the number "1983" would be displayed in year display 16*b*; and the letters "SAT" would be displayed in the day of week display 16*c*. In addition, the current time would be displayed in time display 14**.

Time display 14 is updated frequently so that it always displays the current time, but the remaining elements of month display 10 are updated once each day at the end of the day. For example, if Dec. 31, 1983 had ended and Jan. 1, 1984 had begun, the display would appear as in FIG. 1B. The numbers 1–31 are now displayed beginning with the Sunday in the uppermost row of the day display rows 12, and ending on the Tuesday of the fifth row of day display rows 12. Since today would be January 1, the first Sunday of the month, an indicator at display element **20*b* at the left-hand side of the first row of the day display rows 12 would be activated, thus indicating today's date. In addition, the letters "JAN" would be displayed in month display 16*a*; the number "1984" would be displayed in year display 16*b*; and the letters "SUN" would be displayed in the day of week display 16*c*. The current time would be displayed in time display 14**. This updating would all be done automatically without human intervention.

Under certain circumstances, however, a human operator may wish to directly control the display on month display 10. For example, after a loss of power, or at the beginning of operation, it will be necessary to set month display 10 to the correct year, month, day and time. Similarly, if the operator wishes to view calendar data relating to a previous month or a subsequent month, the operator may change the data on month display 10 to show the desired month. In either case, the operator will push select buttons **18*a* to rotate an indicator in select grid 16*d* until the indicator shows that the desired change can be made. The operator could then switch into the setting mode by pressing mode switch 18*b* and then could shift to a later or earlier time, day, month or year, by pressing either forward button 18*c* or reverse button 18*d*. In this manner, the display of the invention may be controlled to display whatever calendar data the operator desires. Then, by again pressing mode switch 18*b*, month display 10** will again be switched into the display mode, in which the desired calendar data appears.

Figure 2:
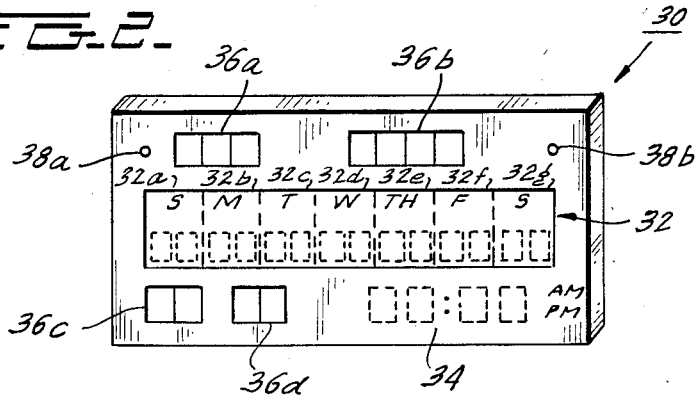
FIG. 2 is a perspective side view of a second embodiment of the invention, capable of displaying one week of a calendar.
Figure 3:
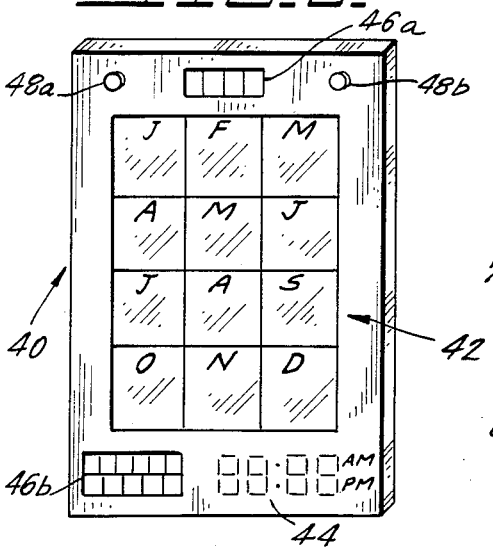
FIG. 3 is a perspective side view of a third embodiment of the invention, capable of displaying a year in calendar form.

Although the above discussion relates to a monthly display as in FIG. 1, the display of the invention may take several forms, depending on the period displayed. FIGS. 2–3 show alternative embodiments of the invention displaying a week and a year, respectively.

2. Monthly Display

Month display 10, as shown in FIG. 1, will now be described in detail. It includes day display rows 12 which are capable of displaying the symbols corresponding to a full month. For a Gregorian or Julian calendar, in which each month may have as many as 31 days, and in which each month may begin on any day of the week, a total of 37 display elements 20 are necessary to display all the possible arrangements in which the days of a month may fall.

As can be seen in FIG. 1, these display elements 20 are arranged in seven columns, each column always corresponding to a predetermined day of the week. In the particular embodiment shown, the display elements 20 are ordered from Sunday through Saturday, but another day of the week, such as Saturday or Monday, could be the first day. In the preferred embodiment, however, the first day will be Saturday, Sunday or Monday, so that each work week of Monday–Friday is displayed on one row. As illustrated, each display element 20 is discrete and includes discrete display segments which are activated to display the numbers or other appropriate symbols corresponding to each day of the month. In the embodiment shown, the display elements 20 are 7-segment displays, but the discrete display elements 20 could also take a number of other forms well known in the art for displaying numbers. As discussed in relation to FIG. 7 below, the display could include dot matrix display elements, for example.

Also, the display elements 20 are arranged into six rows to form day display rows 12. The first five day display rows have seven display elements 20, while the sixth display row, corresponding to the last week of the month, has only two display elements 20.

As can also be seen from FIG. 1, each of the display elements may include display segments which may be selectively activated to display the symbol corresponding to a day of the month. Ordinarily these symbols will be numbers or digits, and FIG. 1 shows that some display elements 20*c* must be capable of displaying two numbers in which the first number may be a "2", other display elements 20*d* need only be able to display a "1" as the first number, while yet other display elements 20*e* need only display one number.

One specific possible arrangement of a display element 20 is shown in more detail in FIG. 1C. As can be seen there, display element 20, arbitrarily chosen to be the first day of the fourth week, must be capable of displaying two numbers. These numbers are displayed on two seven-segment displays, the first including display segments a–g, the second including display segments h–n. In addition, surrounding these seven-segment displays is indicator o, which is activated when the day of the month corresponds to the display element 20 (i.e., the first day of the fourth week in this example). A similar segment or indicator o is associated with each display element 20, so that the person observing the calendar will know the current day of the month by observing which one of the indicators o is activated.

The indicator could take many other forms, such as flashing the display element 20 for the current day. Table 1, below, shows the number to be displayed for the first day of the fourth week and whether each display segment a–n of the display element 20 will be activated when each day of the week is the first day of the month.

TABLE 1

| First Day of Month | Number Displayed | Status of Display Segments for First Day of Fourth Week — Display Segment a | b | c | d | e | f | g | h | i | j | k | l | m | n |
|---|---|---|---|---|---|---|---|---|---|---|---|---|---|---|---|
| Sunday | 22 | 0 | 1 | 1 | 1 | 0 | 1 | 1 | 0 | 1 | 1 | 1 | 0 | 1 | 1 |
| Monday | 21 | 0 | 1 | 1 | 1 | 0 | 1 | 1 | 1 | 0 | 0 | 0 | 0 | 0 | 1 |
| Tuesday | 20 | 0 | 1 | 1 | 1 | 0 | 1 | 1 | 1 | 1 | 1 | 0 | 1 | 1 | 1 |
| Wednesday | 19 | 1 | 0 | 0 | 0 | 0 | 0 | 1 | 1 | 1 | 1 | 1 | 1 | X | 0 |
| Thursday | 18 | 1 | 0 | 0 | 0 | 0 | 0 | 1 | 1 | 1 | 1 | 1 | 1 | 1 | 1 |
| Friday | 17 | 1 | 0 | 0 | 0 | 0 | 0 | 1 | X | 1 | 1 | 0 | 1 | 0 | 0 |
| Saturday | 16 | 1 | 0 | 0 | 0 | 0 | 0 | 1 | 1 | X | 0 | 1 | 1 | 1 | 1 |

0 = off
1 = on
X = don't care

One of ordinary skill in the art could readily prepare similar tables for each of the other display elements 20 in day display rows 12. From these tables, one of ordinary skill in the art could also prepare digital logic in any of several ways which would determine whether to activate a given display segment from a signal indicating on which day of the week the first day of the month falls.

Month display 10 also includes time display 14, month display 16*a*, year display 16*b* and day of week display 16*c*. These displays function to display the current time, month, year and day of week, and are controlled and updated so that they ordinarily display the current calendar data.

In addition, month display 10 includes select grid 16*d*, shown in more detail in FIG. 1D, which is controlled by input means, such as select button 18*a*. Each of the areas of the select grid 16*d* as shown in FIG. 1D is provided with an indicator, such as a light behind the display, controlled such that only one of the indicators is activated at any given time. Operation of the select button 18*a* causes the activated illuminator to turn off and the next indicator in a clockwise direction to be activated. The area of the select grid 16*d* which is illuminated corresponds with a function of the month display, including month, year, day, time, alarm, stopwatch and memo functions.

The mode switch 18*b* is an input means which is used to switch the month display 10 from the select mode, in which operation of the select button 18*a* is performed, into a setting mode, in which forward button 18*c*, reverse button 18*d* and other input means may be used to perform the specified function. Specifically, if the select grid 18*d* is in the month function, then the operation of forward and reverse buttons 18*c*, 18*d* will cause month display 10 to display the next or the previous month from the one currently being displayed. Similarly, if the select grid is in the year, day or time function, operation of the forward and reverse buttons 18*c*, 18*d* will change the year, day and time of month display 10. In addition, month display 10 may contain an alarm, so that if select grid 16*d* is in the alarm function, operation of forward and reverse buttons 18*c* and 18*d* sets the time of the alarm. Also, the time display 14 can operate as a stopwatch, so that when the select grid is in the stopwatch function, operation of forward and reverse buttons 18*c*, 18*d* sets the amount of time at which the stopwatch begins. Finally, month display 10 may be equipped with a memo capability, so that some part of the display may provide information when a set time occurs. For this mode, other input means are required, such as a keyboard or an RS 232 port, with which to enter additional information into month display 10. Also, additional display means may be required if the information to be displayed is alphabetical rather than numeric, as discussed at greater length in relation to FIG. 7, below.

After the operation of forward and reverse buttons 18*c* and 18*d*, the operator may wish to return to the display which was previously being displayed. Operation of return button 18*e* performs this function, causing month display 10 to display the same data which was being displayed prior to the operation of mode switch 18*b* to enter the setting mode. Therefore, after operating mode switch 18*b* to enter the setting mode, the operator may leave the setting mode by pressing either mode switch 18*b* or return switch 18*e*. Pressing mode switch 18*b* will cause month display 10 to continue to display whatever day, month or year the operator has selected in the setting mode. Pressing the return button 18*e*, on the other hand, will cause the display 10 to display the day, month and year which it was displaying prior to entering the setting mode.

Although month display 10 is a presently preferred embodiment, alternative embodiments of the invention display a week or a year, as discussed below.

3. Weekly Display

FIG. 2 shows week display 30 for displaying any selected week. Day display row 32 includes seven distinct display elements 32*a*–32*g*, each corresponding to a day of the week.

In addition to the day display row 32, week display 30 includes time display 34 for displaying the current time of day. In the preferred embodiment of the invention, as discussed in greater detail below, the operation of time display 34 and day display row 32 are controlled in such a manner that day display row 32 ordinarily displays the current week, and is updated to the subsequent week at the same time that time display 34 begins the first day of the subsequent week. In addition, as discussed in greater detail in relation to FIG. 1C above, an indicator may be included in each display element 32*a*–32*g* to indicate the current day of the week, and this indicator will also be updated to correspond with the time display 34.

Week display 30 also includes month display 36*a*, year display 36*b*, day of week display 36*c* and day of month display 36*d* for indicating the current month, year, day of week and day of month, respectively.

FIG. 2 also illustrates input means for providing signals to select the data to be displayed on week display 30. Previous week display button 38*a* causes the day display row 32 to display the week previous to the week currently being displayed, and next week display button 38*b* causes day display row 32 to display the week following the week currently being displayed. In addition, month display 36*a* and year display 36*b* will respond to the signals from previous week and next week display buttons 38*a*, 38*b* to indicate the month and year being displayed.

The embodiment shown in FIG. 2 is a relatively simple embodiment of the invention, and its essential features can also be used for the display means shown in FIGS. 1 and 3. Specifically, the arrangement of seven display elements 32*a*–32*g* for displaying symbols representing the days of the month, with each display element corresponding to a day of the week, can be used in each of the other embodiments.

4. Yearly Display

FIG. 3 shows year display 40 capable of displaying a full year of calendar data. Day display 42 includes twelve groups of rows, each group closely resembling the day display rows 12 of month display 10, as shown in FIG. 1. Minor modifications may be made, however, for those months having less than 31 days, which will therefore not require as many display elements.

Year display 40 also includes time display 44, year display 46*a*, month/day/day-of-week display 46*b*, all resembling the similar displays of month display 10 in FIG. 1 and week display 30 in FIG. 2. In addition, year display 40 includes input means, including previous year button 48*a* and next year button 48*b* for moving to the previous or following year's calendar.

In addition to the features shown in FIG. 3, year display 40 may include additional features like those found in month display 10 as shown in FIG. 1 and week display 30 as shown in FIG. 2. In addition, the circuitry for activating the display elements in each of these displays will be similar, as will be discussed in greater detail below.

5. Control Circuitry

Figure 4:
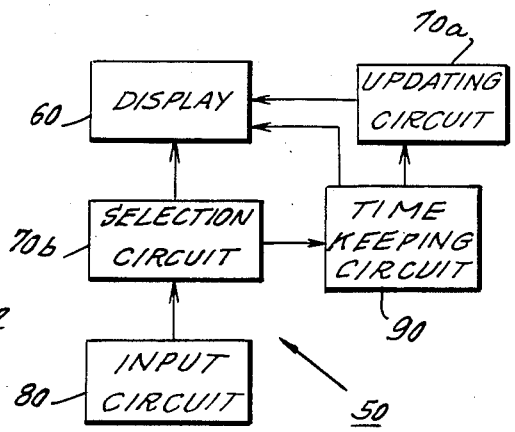
FIG. 4 is a functional block diagram illustrating the operation of the invention.

FIG. 4 shows a functional block diagram of one possible embodiment of the control circuitry 50 of the invention. In this embodiment, control circuitry 50 includes five distinct elements. It should be recognized, however, that the electrical circuits performing the functions of these elements need not be discrete, and may be integrated in any manner, provided that the five basic functions of these elements are performed. In addition, one or more power supplies may be provided to operate the circuits as is well known in the art, and timing circuitry (not shown) may be used in any of several well-known ways to coordinate the operation of the circuits.

The display function is performed by display 60 which operates in response to signals from updating circuit 70*a* and selection circuit 70*b*. As discussed above in relation to the embodiment of FIG. 1C, the activation of specific display segments a–n is determined by a signal indicating which day of the week corresponds to the first day of the month. Therefore, in one embodiment of the invention, either updating circuit 70*a* or selection circuit 70*b* may output several signals including a signal indicating the first day of the month to display 60, and circuitry in display 60 will activate the appropriate display elements in response to these signals.

Updating circuit 70*a*, discussed in greater detail in relation to FIGS. 5 and 6, below, updates the data displayed on display 60. As shown in FIG. 4, updating circuit 70*a* receives information about the current time from time-keeping circuit 90. The information from the time-keeping circuit 90 can be serial or parallel, and could be provided constantly or only when a value to be displayed changes. In one simple embodiment, for example, time-keeping circuit 90 could provide a signal on a specific line at the end of a day. Based on this signal, updating circuit 70*a* would send out signals to display 60 for activating the appropriate display elements to update the data displayed.

Figure 6A:
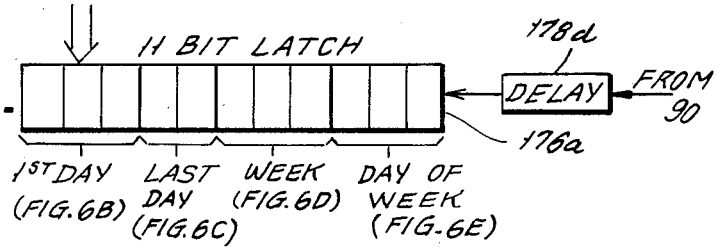
FIG. 6A is a schematic diagram of an 11-bit latch for use in the logic circuit of the embodiment of FIG. 6.
Figure 6B:
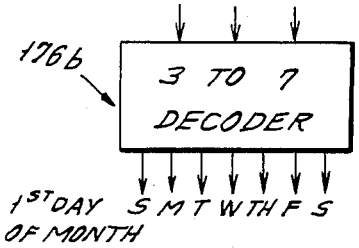
FIG. 6B is a schematic diagram of a first day of month decoder for use in the logic circuit of the embodiment of FIG. 6.
Figure 6C:
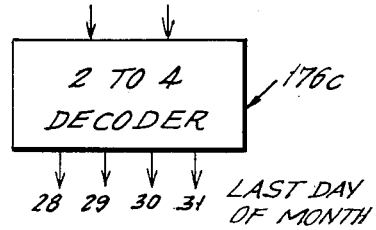
FIG. 6C is a schematic diagram of a last day of month decoder for use in the logic circuit of the embodiment of FIG. 6.
Figure 6D:
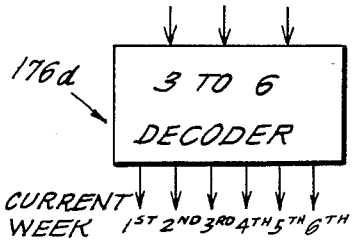
FIG. 6D is a schematic diagram of a current week decoder for use in the logic circuit of the embodiment shown in FIG. 6.
Figure 6E:
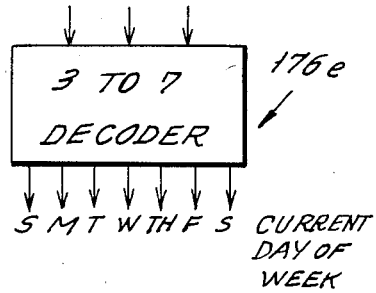
FIG. 6E is a schematic diagram of a current day of week decoder for use in the logic circuit of the embodiment shown in FIG. 6.
Figure 5:
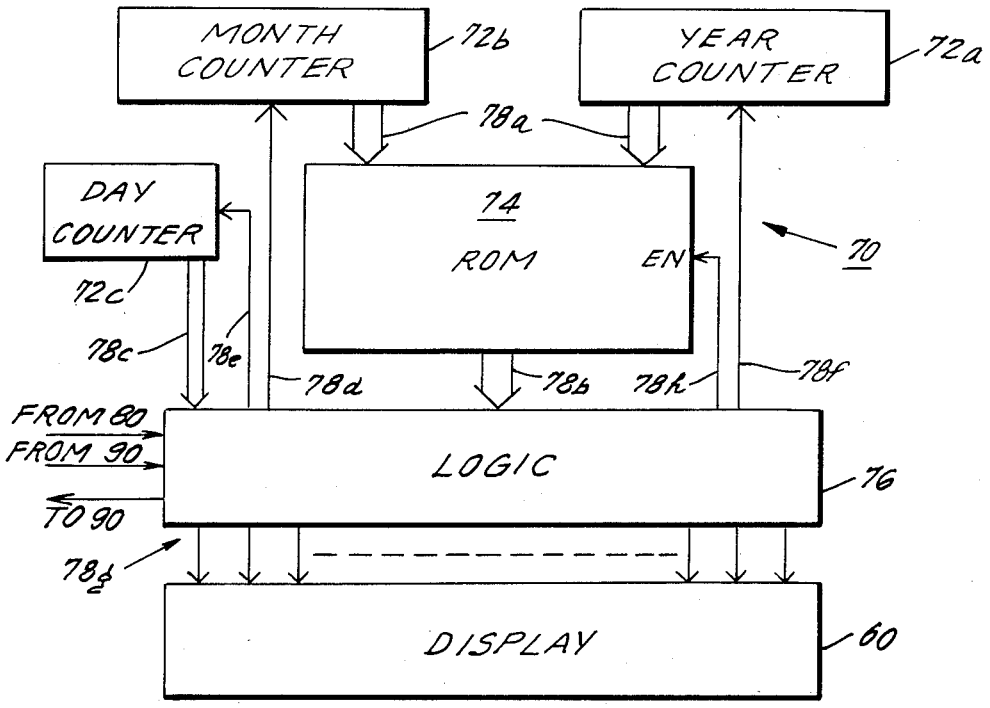
FIG. 5 is a block diagram showing in detail the components of the updating and selection circuits of FIG. 4 in one embodiment of the invention.
Figure 6:
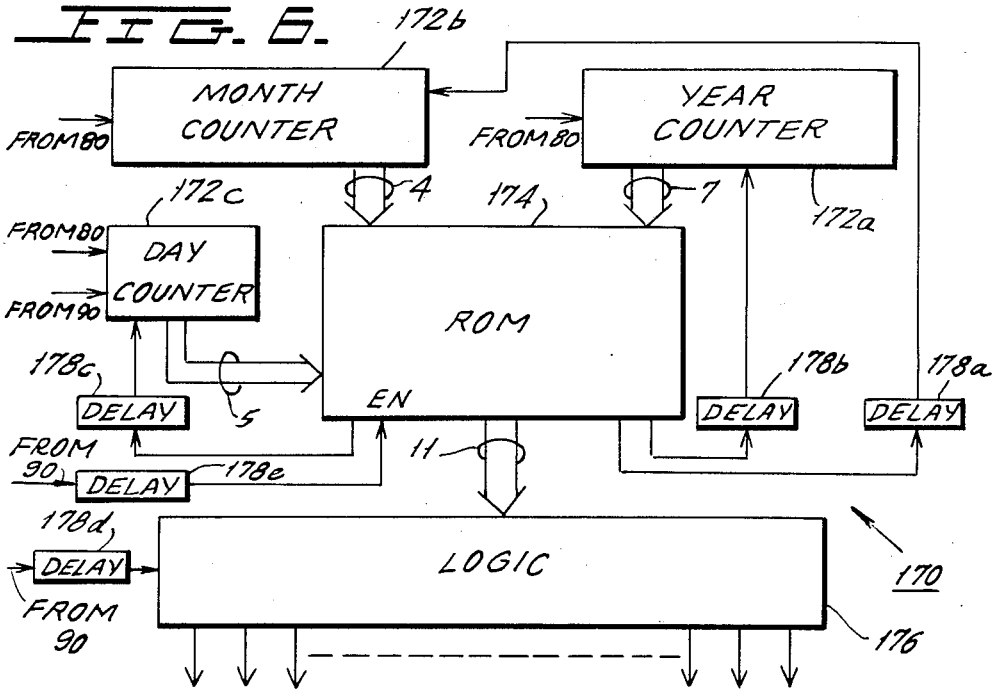
FIG. 6 is a block diagram showing the components of the updating and selection circuits of FIG. 4 in an alternative embodiment of the invention.

Selection circuit 70*b*, also discussed in greater detail in relation to FIGS. 5 and 6, changes the calendar data displayed on display 60 in accordance with selection information from an operator. The operator enters the selection information through input circuit 80, which, in the embodiment shown in FIG. 1, for example, would include push-buttons 18*a*–18*d*. If the selection signals indicate that the time-keeping circuit 90 should be set, selection circuit 70*b* sends out signals to time-keeping circuit 90 to set it correctly. For example, selection circuit 70*b* could send a signal on one line to indicate a setting operation and signals on parallel lines indicating which of several counters in time-keeping circuit 90 should be set. Then a signal on yet other parallel lines could indicate whether to increment or decrement the counter indicated. On the other hand, if the selection signals call for the display of a previous or subsequent week, month or year, selection circuit 70*b* sends the necessary signals to display 60 for activating the appropriate display elements.

In the embodiment shown in FIG. 4, time-keeping circuit 90 also provides output signals directly to display 60 for display of the current time. For example, in one simple embodiment, the 4-bit binary-coded-decimal (BCD) value for each of the three right elements of the time display 14 could be provided, together with one bit each to indicate whether a "1" should be displayed in the left element and whether "AM" or "PM" should be displayed. Thus, fourteen parallel bits could provide the necessary information. Alternatively, time-keeping circuit 90 provides the current time to updating circuit 70*a*, which then activates the appropriate elements of display 60 to provide a display of the current time.

In the preferred embodiment of the invention, updating circuit 70*a* and selection circuit 70*b* are digital circuits. Each of the other components shown in FIG. 4 is not solely digital but may be thought of as interfacing with other types of signals. Specifically, input circuit 80 receives signals from an operator, ordinarily manual signals from push buttons or from a keyboard, and converts them into digital signals for selection circuit 70*b*. Display 60, on the other hand, receives digital signals from updating circuit 70*a*, selection circuit 70*b* and time-keeping circuit 90 and converts them into a visual display signal. Time-keeping circuit 90 receives signals from a clock source (not shown) and converts them into a digital signal corresponding to the current time.

As pointed out above, some of the digital logic which determines how the display elements are activated may be in the display 60, while other digital logic for activating the display elements is in updating circuit 70*a*, selection circuit 70*b* and, in one embodiment, time-keeping circuit 90. In general, however, this digital circuitry for activating display 60 may be realized in a single larger circuit which will be referred to as the activating circuit. As discussed below, FIGS. 5 and 6 show two alternative embodiments of the activating circuit.

6. First Embodiment of Activating Circuit

FIG. 5 shows a general embodiment of an activating circuit 70, connected to display 60 for activating the display elements and combining the functions of updating circuit 70*a* and selection circuit 70*b*. In this embodiment, activating circuit 70 includes three counters, year counter 72*a*, month counter 72*b* and day counter 72*c*, each of which maintains a count representing the current year, month and day, respectively. Of these counters, year counter 72*a* and month counter 72*b* apply signals on address lines 78*a* to address read-only memory (ROM) 74 which contains a look-up table storing information about each year and each month of the year to be displayed. Although other digital components could be used in place of ROM 74, in the preferred embodiment of the invention ROM 74 is switchable or removable and replaceable for providing a different look-up table in activating circuit 70. This feature permits the invention to be more flexible. For example, if it is possible to store the necessary information relating to a period of 40 years on a single ROM 74, it would be possible to provide additional 40-year periods on other ROMs, each of which could be connected or switched into the circuit when display of information about a particular year is desired. Alternatively, the different look-up tables could be used to provide different sorts of information, such as about the Hebrew calendar or about alphabetical representations of the days of the week and months of the year in another language.

When logic 76 sends an enable signal on line 78*h*, the output from ROM 74 goes over data lines 78*b* to logic 76, which also receives inputs on data lines 78*c* from day counter 72*c*, input circuit 80 and time-keeping circuit 90. In response to these inputs, logic 76 controls each of the counters 72*a*–72*c* over control lines 78*d*, 78*e*, 78*f*, and also sends signals over output lines 78*g* to the display elements in display 60, causing the elements to display the appropriate calendar data. Also, logic 76 may send out signals for setting time-keeping circuit 90, as shown.

In general, logic 76 may be realized in many ways, including an appropriately programmed microprocessor or hard-wired digital logic. As discussed below, the embodiment shown in FIG. 6 relies on relatively simple and well known hard-wired digital logic. The preferred embodiment shown in FIGS. 7, 8 and 9, however, uses a programmed microprocessor to realize a variation of the activating circuit 70 shown in FIG. 5.

7. Second Embodiment of Activating Circuit

A second embodiment of an activating circuit 170 is shown in FIG. 6, and some of its details are further shown in FIGS. 6A–6E. In this embodiment, selection circuit 170 does not include a microprocessor or other central processing unit as that term is ordinarily understood, but rather consists of a relatively simple arrangement of digital logic components.

As in activating circuit 70, activating circuit 170 includes year counter 172*a*, month counter 172*b* and day counter 172*c*. The outputs from year counter 172*a* are seven bits in length to permit the addressing of as many as 128 years. More conveniently, however, it may be appropriate to address only 100 years, so that year counter may reset back to 0 when incremented from 99. In this manner, ROM 174 could contain the calendar information relating to a given century, and could be replaced by another ROM if calendar information about a different century is desired. Month counter 172*b* has an output of 4 bits, which would permit representation of as many as 16 months. For the Gregorian calendar, of course, only 12 months are used, so that this counter could reset back to the first month when incremented from the twelfth month. Finally, day counter 172*c* has an output of 5 bits, permitting it to count from 0 to 31 days. Unlike year counter 172*a* and month counter 172*b*, day counter 172*c* should not be self-resetting, however, because the number of days in a month will vary, and therefore, one line from ROM 174 goes to reset day counter 172*c* to zero when the last day of the month is reached. In addition, two lines from ROM 174 go to increment counters 172*a* and 172*b* when appropriate.

In the embodiment shown, ROM 174 is a 16-bit addressable ROM an has at least 14 bits output. Of these 14 bits, 11 bits are provided to logic 176 for further processing as shown in FIGS. 6A–6E. Initially, these 11 bits are stored in latch 176*a*, as shown in FIG. 6A, latch 176*a* functioning simply as a buffer to hold the outputs of ROM 174. Latch 176*a* thus makes it possible to store an 11-bit valve read out from ROM 174 throughout a day, even though other outputs from ROM 174 have incremented or reset counters 172*a*, 172*b*, 172*c*, changing the ROM output. From latch 176*a*, the output values go to the decoders shown in FIGS. 6B–6E.

In the embodiment of FIG. 6, delays 178*a*, 178*b*, 178*c* are connected in the output lines from ROM 174 to counters 172*a*, 172*b*, 172*c*, respectively. This is one possible way of holding the outputs of ROM 174 stable until they have been stored in latch 176*a*. Thus, when time-keeping circuit 90 signals that a new day has begun, day counter 172*c* is incremented by 1. After a suitable delay 178*e*, the signal from circuit 90 enables the output from ROM 174. The signal from circuit 90 also goes to latch 176*a* after delay 178*d* of sufficient length to permit signal propagation to the latch inputs, and latch 176*a* is then enabled to be rewritten with the new ROM outputs. Delays 178*a*, 178*b*, 178*c* prevent counters 172*a*, 172*b*, 172*c* from being incremented or reset until that can be done without changing the value stored in latch 176*a*.

FIG. 6B shows how the first three bits of latch 176*a* are decoded into the first day of the month. The design of digital logic decoding a number such as 3 bits into another number such as 7 bits is well known in the art and it is apparent from the above discussion of FIG. 1C that the output of decoder 176*b* is sufficient to determine the numbers to be displayed in each display area of the calendar. In other words, the number to be displayed depends entirely on which day of the week is the first day of the month. It also follows that the three bits input to decoder 176*b* will be the same for all the days of a given month, so that the ROM 174 can be programmed to have a single value in these three bits for each value of the month and year.

FIG. 6C shows a 2-bit to 4-bit decoder 176*c* for decoding two bits of output from ROM 174 into one of four bits, indicating which day is the last day of the month. The outputs from decoder 176*c* will be connected to logic controlling the display elements in the fifth and sixth rows of day display rows 12 as shown in FIG. 1. Using simple and well known digital logic, specific display elements in these rows can be disabled if the last day of the month being displayed occurs before the number which they would display. For example, the display element for the first day of the fifth week will be disabled if the first day of the month is Sunday and the last day of the month is the 28th day, so that these lines may be input to a NAND gate to obtain an enabling signal. In all other cases, this display area will then be enabled. Therefore, decoders 176*b*, 176*c* are sufficient to provide a display of the month in ordinary calendar form.

FIG. 6D shows 3-bit to 6-bit decoder 176*d* for decoding three bits into one of six signals indicating which row of the day display rows 12 is the current week. Similarly, FIG. 6E shows 3-bit to 7-bit decoder 176*e* which decodes three bits into one of seven signals indicating the current day of the week. Each display area, as shown in FIG. 1C, includes indicator o for indicating that the display area represents the current day. Therefore, each indicator o will be activated only when the output from decoder 176*d* indicates that its week is the current week and the output from decoder 176*e* indicates that the current day of the week is the same as its day of the week. The two appropriate lines can be input to an AND gate corresponding to each display area to control its indicator o. In addition, the output from decoder 176*e* can be used to control day of week display 16*c* as shown in FIG. 1 to indicate the current day of the week.

As also shown in FIG. 6, day counter 172*c* receives an input from time-keeping circuit 90, causing it to increment to the next day. In this embodiment, the output of the time-keeping circuit 90 indicating the current time of day, however, goes directly to display 60, where it is displayed in time display 14, as shown in FIG. 1.

Counters 172*a*, 172*b*, 172*c* each receive inputs incrementing or decrementing them from forward and reverse buttons 18*c*, 18*d*. In this manner, the display can be manually controlled to cause it to display any desired month of any year which is included on ROM 174. Furthermore, the outputs from month counter 172*b* can go directly to control month display 16*a*, shown in FIG. 1, and the outputs from year counter 172*a* can go directly to control year display 16*b* in FIG. 1.

Although the embodiment shown in FIG. 6 is helpful to understand the operation of the invention, it makes use of electronic circuitry which is probably not cost-effective. Therefore, the preferred embodiment, making use of a microprocessor or microcomputer, is discussed below.

8. Third Embodiment

Figure 7:
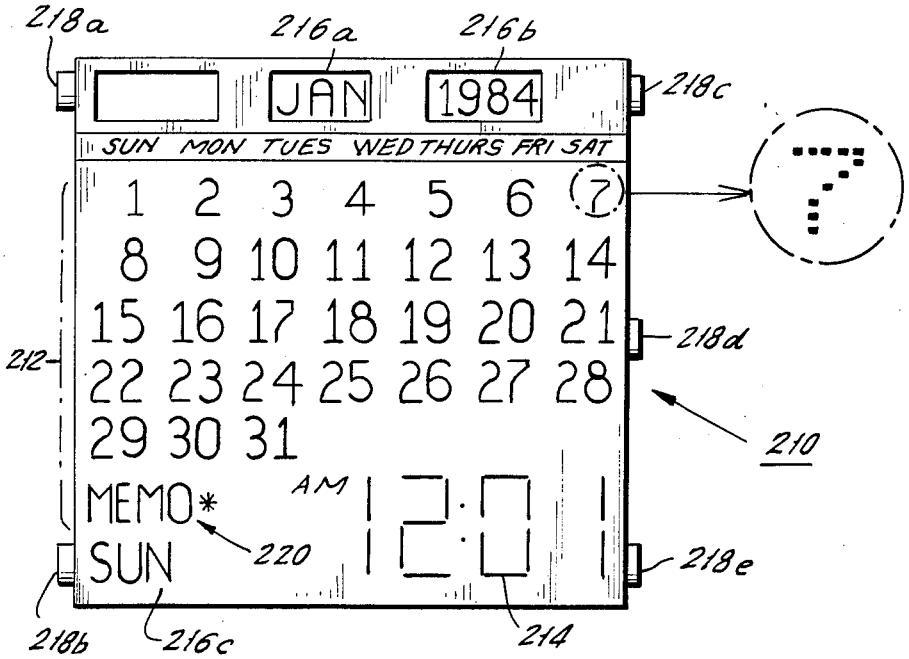
FIG. 7 is a side view of a display of a preferred embodiment of the invention, capable of displaying one month of a calendar.
Figure 7A:
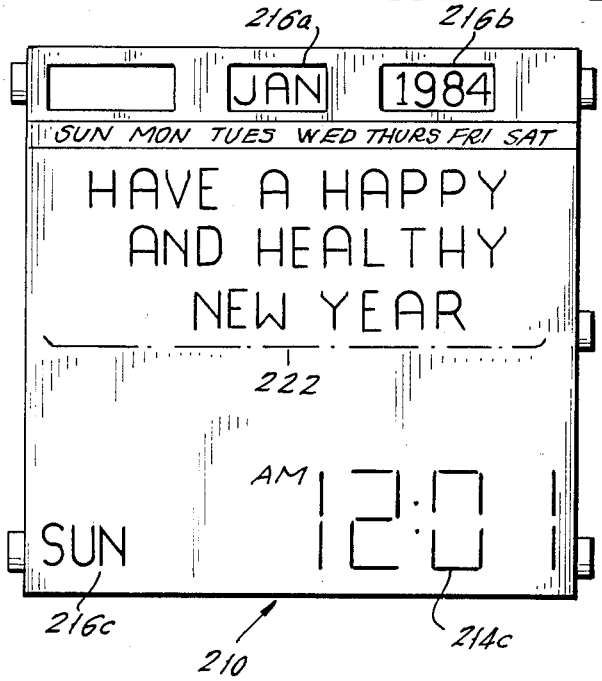
FIG. 7A is a side view of the display of FIG. 7, shown displaying a memo message.
Figure 8A:
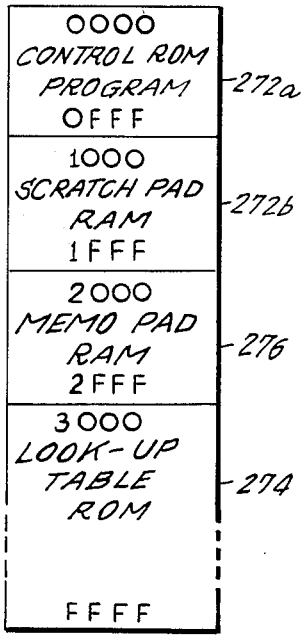
FIG. 8A is a memory map for the microprocessor of FIG. 8.
Figure 8:
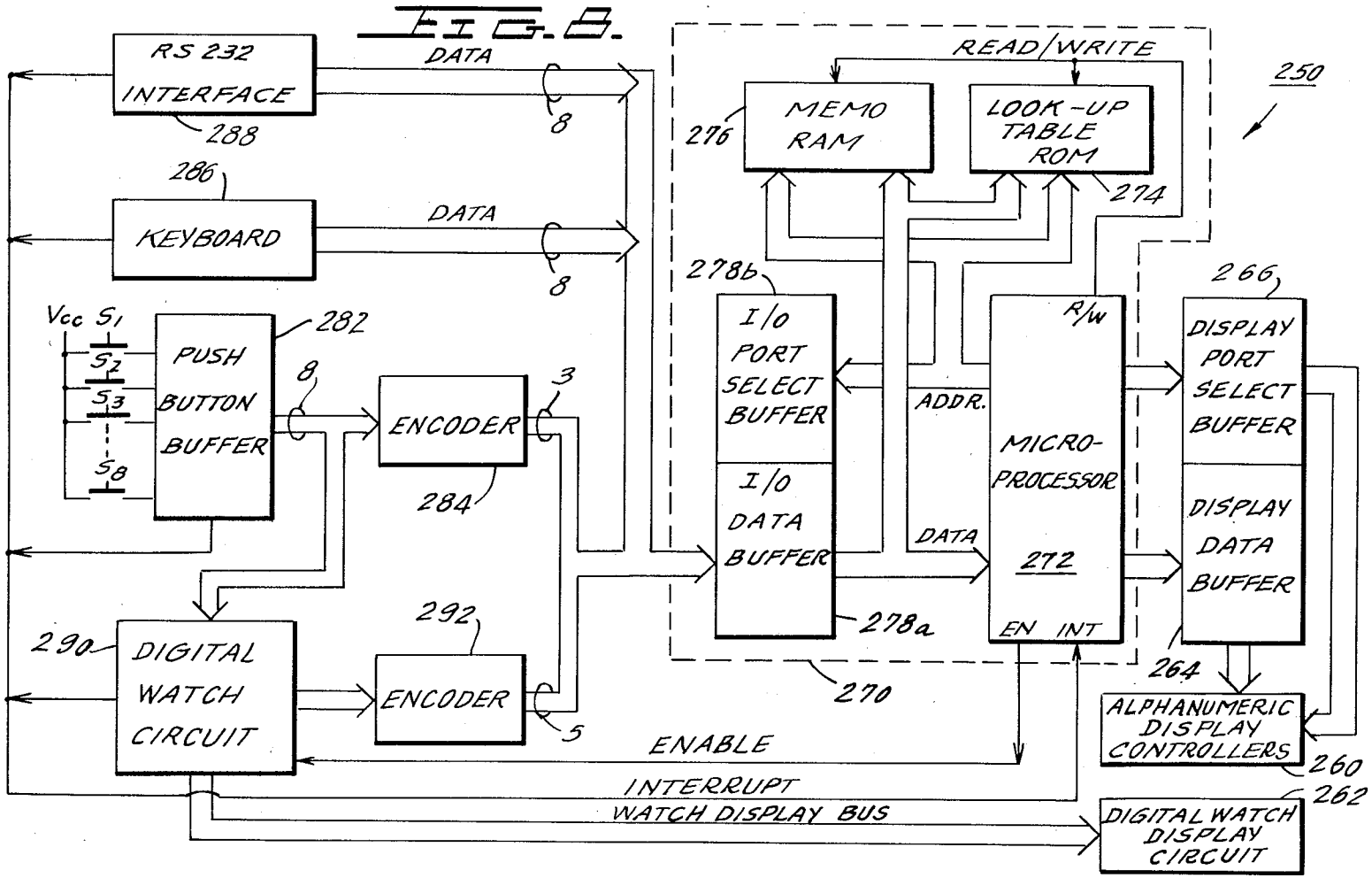
FIG. 8 is a schematic circuit diagram of control circuitry for the display of FIG. 7.

A third embodiment of the invention uses a microprocessor or microcomputer as the central component of activating circuit 270, as shown in FIG. 8. Recent advances in electronic technology are likely to make this embodiment cost effective for mass production, so that it is presently the preferred embodiment. In addition, as will be discussed in relation to FIG. 7, this embodiment makes possible the use of alphanumeric displays which are easily interfaced to a microprocessor, further facilitating manufacture.

FIG. 7 shows monthly display 210 closely resembling monthly display 10 shown in FIG. 1. As shown, monthly display 210 includes six day display rows 212, each of which is a dot matrix display panel, a row of 13 segment displays, or any other similar arrangement of display elements using LED, LCD or other appropriate display apparatus. For example, components from the 5×7 dot matrix alphanumeric display system, HDSP-24XX series, manufactured by Hewlett Packard Company could be used for display rows 212. Time display 214 is a standard digital watch display module. Month display 216*a*, year display 216*b* and day of week display 216*c* could also be formed of display panels from an HDSP-24XX dot matrix display panel. For purposes of illustration, FIG. 7 shows a display of the same data as in FIG. 1B, described above.

An important additional feature of this preferred embodiment is the memo capability. As shown in FIG. 7, display elements 220 in the last row of day display row 212 are used to indicate that a memo message has been stored in memory to be recalled on the current day. By pressing select button 218*a*, the operator can select the memo mode. When the memo mode is selected, operation of mode switch 218*b* switches month display 210 to the setting mode in which the stored memo message 222 is displayed on the dot matrix display panels of day display rows 212, as shown in FIG.

7A. The memo message may be a holiday message, as shown, or any other appropriate message.

FIG. 8 shows a schematic circuit diagram of control circuitry 250 which can be used to control month display 210 shown in FIG. 7. As shown in FIG. 8, control circuitry 250 includes alphanumeric display controllers 260 which form a standard part of the Hewlett Packard HDSPP-24XX series of alphanumeric display systems discussed above. In addition, digital watch display control 262 control time display 214.

The information necessary for alphanumeric display controllers 260 is received from activating circuit 270, the central component of which is microprocessor 272. As shown in FIG. 8, microprocessor 272 is connected to alphanumeric display controllers 260 through display data buffer 262 and display port select buffer 264. These buffers can be standard octal buffers such as 74,240 integrated circuits or other equivalent circuits. Display port select buffer 266 contains an address indicating which of the controllers 260 should receive the data stored in display data buffer 264. These buffers operate to hold the previously received data and address until microprocessor 272 provides new data and address.

In addition to microprocessor 272, activating circuit 270 includes look-up table ROM 274, memo random access memory (RAM) 276, input/output data buffer 278*a* and input/output port select buffer 278*b*. Microprocessor 272 may be any standard microprocessor or microcomputer, such as a member of the INTEL 8048 family or the Motorola MC 6801 family. Look-up table ROM 274 could be any standard ROM, PROM, EPROM or other preprogrammed memories, such as one or more 2764 integrated circuit, and memo RAM 276 could be any standard RAM, such as one or more 2114 or 6116 integrated circuit. Input/output data buffer 278*a* and input/output port select buffer 278*b* could be standard octal buffers such as 74,240 integrated circuits or other equivalent circuits.

The operation of microprocessor 272 will be discussed in more detail in relation to FIG. 9, below. It is worth noting, however, that the memory map of microprocessor 272, shown in FIG. 8A includes, in addition to look-up table ROM 274 and memo RAM 276, the control ROM program 272*a*, which will ordinarily be stored on microprocessor 272. Alternatively, this could be stored in a standard 2716 or 2732 integrated circuit. Similarly, scratch pad RAM 272*b* will ordinarily cover a small amount of the memory space, and will ordinarily be on microprocessor 272.

The operation inputs to microprocessor 272 are entered through input/output port select buffer 278, and include push-button inputs $S_1$–$S_8$ entered through push-button buffer 282, which may be a standard octal buffer such as a 74,240 integrated circuit. Push-buttons $S_1$–$S_8$ will include select button 218*a*, mode switch button 218*b*, forward button 218*c*, reverse button 218*d* and return button 218*e*, all discussed above. Inputs from push-button buffer 282 are encoded in an 8 to 3 bit encoder 284, such as a standard 74148 integrated circuit. In addition, whenever any of switches $S_1$–$S_8$ is closed, an interrupt signal goes to microprocessor 272, causing it to execute an interrupt routine discussed in greater detail in relation to FIG. 9. Similarly, whenever digital watch circuit 290 indicates the end of a day, the interrupt routine will be executed, including a signal to enable digital watch circuit 290 to send its output to encoder 292. The outputs from encoder 292 are combined with those from encoder 284 and are fed to microprocessor 272 through input/output data buffer 278*a*.

Other operator inputs include keyboard 286 and RS 232 interface 288, both of which permit interaction with microprocessor 272 in order to store memo messages in memo RAM 276. Inputs from these components are also preceded by an interrupt signal, causing microprocessor 272 to execute an interrupt routine from control ROM 272*a*.

In addition to the connections shown in FIG. 8, microprocessor 272 will also have enabling lines, not shown, for controlling operation of the other components, including buffers 264, 266, 278*a*, 278*b*, ROM 276, RAM 276, keyboard 286 and RS 232 interface 288. Also, control circuitry 250 will include additional circuitry, not shown, to provide power to the components and to ensure proper timing.

The operation of microprocessor 272 in FIG. 8 can be understood more clearly from the flow chart of FIG. 9, together with the following discussion. As shown in FIG. 9, the operation of microprocessor 272 is centered around the detection of an interrupt in decision block 304. It is necessary, however, that a portion of the control program stored in control ROM 272*a* provide a routine for initializing microprocessor 272 when power is turned on. Therefore, block 300 indicates the power on condition, and block 302 indicates that the microprocessor 272 is initialized. In block 302, a routine is executed which initializes a number of registers in scratch pad RAM 272*b*. Some of these registers correspond to counters 72*a*, 72*b*, 72*c* from FIG. 5, and represent the current year, month and day. Other registers will be initialized relating to operator selected calendar data, to alarm data and so forth. A stack of registers may also be initialized in order to store data relating to interrupt requests received in a sequence. Once the initializing has been completed, it need not be repeated until the microprocessor 272 is again turned on. In order to alert the operator to the fact that the data displayed may be inaccurate due to the loss of power, the initializing performed in block 302 may include flashing the display or providing a message indicating invalid data.

Decision block 304 tests the interrupt line to the microprocessor to determine whether any of the input sources have sent out an interrupt request. If not, microprocessor 272 merely loops, with a suitable delay, and repeats block 304. On the other hand, if an interrupt has been received, microprocessor 272 reads each of the input ports by addressing the input/output port select buffer 278*b*, in order to determine the appropriate routine for execution.

The first port to be read is the buffer/watch port, which is read in block 308. Before reading this port, however, microprocessor 272 must enable watch circuit 290, in block 306. After reading the port, microprocessor 272 tests the time received from watch circuit 290 to determine whether a new day has begun in block 310. If so, microprocessor 272 increments its day register in scratch pad RAM 272*b*, as shown in block 312. It then addresses look-up table ROM 274, as shown in block 314, to obtain the new calendar data. Using this data, it updates the registers in scratch pad RAM 272*b*, as shown in block 316. If it is not the end of a day, or when the registers have been updated in block 316, microprocessor 272 tests the input from encoder 284, designated as i, to determine whether it is 0, as shown in in block 318. If i is not equal to 0, microprocessor 272 executes a routine corresponding to the value of i, the purpose of this routine being to perform the function requested by the operator. After executing each such routine in block 320, microprocessor 272 again tests the value of i in block 318, to check whether further switches have been closed. If i=0, indicating that none of the switches have been closed, microprocessor 272 next tests a register which counts the number of times it has detected that i=0. If this register, designated n, is less than 1,000, an arbitrary number allowing time for the operator to push an additional push-button, microprocessor 272 increments n, and then repeats its test of whether i=0. When n reaches 1,000, microprocessor 272 proceeds to reset n to 0 and read the keyboard port in block 326.

When microprocessor 272 has read the keyboard port, it tests to determine whether an input has been received from the keyboard 286 in block 328. If so, it executes an appropriate keyboard routine in block 330, and this routine may include an interactive operation in which microprocessor 272 displays alphanumeric information on month display 210. In this manner, an operator may enter memo messages into memo RAM 276 to be recalled at a certain date. When this routine has been completed, or if there is no keyboard input, microprocessor 272 proceeds to read the RS 232 port.

Just as with the keyboard port, when microprocessor 272 has read the RS 232 port, it first tests in block 334 to determine whether any input has been received from the RS 232 interface 288. If so, it executes an appropriate RS 232 routine in block 336. Here again, the routine may be interactive, since the device connected to the RS 232 interface may be the equivalent of a keyboard or other manual entry device.

When the RS 232 routine has been executed, or if there is no RS 232 input, microprocessor 272 proceeds to update the display in block 338. This step consists of sending the appropriate data to display data buffer 264 and display port select buffer 266 to permit alphanumeric display controllers 260 to display the correct calendar data.

It should be emphasized that the above described flow chart, shown in FIG. 9, is merely one example of how microprocessor 272 may be programmed in order to control display 210. Similarly, the combination of components shown in FIG. 8 could be changed to meet specific design requirements, such as requirements for additional inputs to microprocessor 272 or for a different allocation of the memory space. It should further be emphasized that the invention could be combined with an existing microprocessor control circuit, such as the circuit used on a microwave oven or other appliance. In that case, the circuitry shown in FIG. 8 and the flow chart shown in FIG. 9 could be combined with the existing circuitry and programming for controlling both the electronic calendar of the invention and the appliance.

9. Miscellaneous Additional Features

In one embodiment of the invention, the time-keeping circuit 90 is an ordinary digital watch, connected to provide the necessary inputs to updating circuit 70*a* and display 60, and to be reset by signals from selection circuit 70*b*. It is contemplated that the entire invention could be made in the form of a wrist-watch-calendar.

As discussed above, ROM 74 as shown in FIG. 5 can be used to store a look-up table relating to a specific period of years, such as a specific century or other period of years. In an alternative embodiment, however, the look-up table could be used to store a group of rules which may be employed by logic 76 to determine which display elements must be activated. Specifically, the rules governing the Gregorian calendar could be stored in ROM 74 in such a manner that the month counter and year counter would address ROM 74 to read out the rules applying to any specific month. In response to an address from the month calendar, ROM 74 could indicate whether that month had 31 days, 30 days or was February. In response to an address from the year counter, ROM 74 could indicate whether that year was a leap year in which February has 29 days. Because only years divisible by 4 are leap years, the third bit of a binary year counter could be used directly to indicate most leap years. Under the Gregorian calendar, however, years divisible by 400, such as the year 2,000, are not leap years, so that ROM 74 or a counter could provide an indication that the year falls into this category.

10. Glossary

The following terms which appear in the claims or the specification have the meanings indicated:

Calendar data: data of any sort relating to days, weeks, months or years, including, for example, the numerical symbols for the days of a particular week, month or year.

Day of a month: a day falling in a particular month, usually represented by a number.

Date symbol: a symbol representing a day of a month, such as a one or two-digit number.

Display element: a discrete element capable of displaying one date symbol, including but not limited to an arrangement of light emitting diodes (LEDs) operating as 7- or 13-segment displays or dot matrix displays or a similar liquid-crystal display (LCD) arrangement.

Display segment: a discrete segment of a display element which is separately activated, such as a single LED in a 7- or 13-segment display or a dot in a dot matrix display.

Day of the week: one of the seven days which occurs in every full week, i.e. Sunday, Monday, Tuesday, Wednesday, Thursday, Friday and Saturday.

Calendar week: those days of one month which fall within a single week, whether a full or partial week; for example, if the last week of January, 1984 begins on Sunday, Jan. 29, the last calendar week of January, 1984 will be Jan. 29–31, and the first calendar week of February, 1984 would be Feb. 1–4.

Work week: the ordinary working days of a calendar week, such as Monday–Friday of a full week.

Current time: the correct present time of day in the time zone in which one is located, such as 12:05 A.M. Eastern Standard Time.

Current day: the day in which the current time falls.

Current week: the calendar week in which the current day falls.

Current month: the month in which the current day falls.

Following month: the month after the current month.

Following week: the next calendar week of the current month after the current week or, if none, the first calendar week of the following month.

Time symbol: an arrangement of symbols for representing a time of day, such as "12:05 A.M.".

Month symbol: an arrangement of symbols for representing a month, such as "DEC" or "12" for December.

Year symbol: an arrangement of symbols for representing a year, such as "1984" or "84".

Look-up table: a collection of data in a form suitable for ready access and retrieval.

RAM: read/write memory.

ROM: read-only memory.

Although the present invention has been described in connection with a number of preferred embodiments thereof, many other variations and modifications will now become apparent to those skilled in the art. The present invention is limited, therefore, not by the specific disclosure herein, but only by the appended claims.

What is claimed is:

1. A device for displaying calendar data, comprising:

a display for displaying data, comprising a first plurality of rows of discrete display elements, each display element in each row being in a respective column, each column always displaying a particular day of the week which is unique to that column such that each respective column always displays the same day of the week even when the data being displayed is changed by an updating circuit, each display element being selectively activable to display one of a plurality of date symbols, each date symbol representing a day of a month, the rows being arranged parallel to each other for displaying the calendar weeks of a month; and said updating circuit being for updating said display and for selectively activating the display elements to display the date symbols representing the days of each calendar week of the current month in a respective row and to display the date symbol representing each day of the current month in the column always displaying the day of the week on which that day falls, said updating circuit further being for automatically updating said display at the end of each current month to display the date symbols corresponding to the days of the following month.

2. The device of claim 1 in which the first plurality of rows is six rows, five of said rows for displaying the first five calendar weeks of a month and each having seven display elements and one row for displaying the sixth calendar week of a month and having two display elements.

3. The device of claim 1 in which the leftmost display elements of all of the rows define a leftmost column, said leftmost column always displaying Sunday.

4. The device of claim 1 in which the display comprises twelve pluralities of rows like said first plurality of rows, said first plurality of rows being one of said twelve pluralities of rows, said twelve pluralities being arranged for displaying a year.

5. The device of claim 1 in which at least one of the display elements comprises two groups of display segments, each group for displaying one digit of a two-digit number.

6. The device of claim 5 in which each group of display segments is a seven-segment display.

7. The device of claim 1 in which each display element comprises an indicator for indicating that the day corresponding to the date symbol displayed by that display element is the current day.

8. The device of claim 1 in which the display further comprises a month display for selectively displaying one of a plurality of month symbols, each month symbol corresponding to a month.

9. The device of claim 1 in which the display further comprises a year display for selectively displaying one of a plurality of year symbols, each year symbol corresponding to a year.

10. The device of claim 1 in which the display further comprises a time display for selectively displaying one of a plurality of time symbols, each time symbol corresponding to a time of day.

11. The device of claim 1 in which the updating circuit comprises a look-up table for providing signals for selectively activating the display elements.

12. The device of claim 11 in which the look-up table is a ROM, the updating circuit further comprising an addressing circuit for addressing the ROM to provide signals and a logic circuit for processing the signals provided by the ROM.

13. The device of claim 12 in which the ROM is removably connected to the updating circuit so that the ROM may be removed and replaced with another ROM.

14. The device of claim 1 further comprising a time-keeping circuit for providing time signals, said time signals controlling said updating circuit.

15. The device of claim 14 in which the display further comprises a time display for selectively displaying one of a plurality of time symbols, each time symbol corresponding to a time of day, the time signals provided by the time-keeping circuit further selectively activating the time display to display the time symbol corresponding to the current time.

16. The device of claim 14 in which the time-keeping circuit is a watch.

17. The device of claim 14, further comprising an input circuit for setting the time-keeping circuit to the current time.

18. The device of claim 1, further comprising an input circuit for providing selection signals indicating calendar data selected by an operator and further comprising a selection circuit for selectively activating said display elements to display calendar data selected by the operator in response to the selection signals, each column displaying the same day of the week even when the calendar data being displayed is changed by said selection circuit.

19. A device for displaying calendar data, comprising:

a display for displaying data, comprising a row of display elements for displaying a calendar week, each display element being in a respective column, each column always displaying a particular day of the week which is unique to that column such that each respective column always displays the same day of the week even when the calendar week being displayed is changed by an updating circuit, each display element being selectively activable to display one of a plurality of date symbols, each date symbol representing a day of the month; and said updating circuit being for updating said display and for selectively activating the display elements to display the date symbols representing the days of the current week of the current month, each date symbol representing a day of said current week being displayed in the respective column displaying the day of the week on which that day falls, said updating circuit further being for automatically updating said display at the end of each current week to display the date symbols corresponding to the days of the following week.

20. The device of claim 19 in which said row comprises seven display elements.

21. The device of claim 20 in which the leftmost display element in said row is in a leftmost column, the leftmost column always displaying Sunday.

22. The device of claim 19 in which at least one of the display elements comprises two groups of display segments, each group for displaying one digit of a two-digit number.

23. The device of claim 22 in which each group of display segments is a seven-segment display.

24. The device of claim 19 in which each display element comprises an indicator for indicating that the current day is represented by the date symbol displayed by that display element.

25. The device of claim 19 in which the display further comprises a month display for selectively displaying one of a plurality of month symbols, each month symbol corresponding to a month.

26. The device of claim 19 in which the display further comprises a year display for selectively displaying one of a plurality of year symbols, each year symbol corresponding to a year.

27. The device of claim 19 in which the display further comprises a time display for selectively displaying one of a plurality of time symbols, each time symbol corresponding to a time of day.

28. The device of claim 19 in which the updating circuit comprises a look-up table for providing signals for selectively activating the display elements.

29. The device of claim 28 in which the look-up table is a ROM, the updating circuit further comprising an addressing circuit for addressing the ROM to provide signals and a logic circuit for processing the signals provided by the ROM.

30. The device of claim 29 in which the ROM is removably connected to the updating circuit so that the ROM may be removed and replaced with another ROM.

31. The device of claim 19 further comprising a time-keeping circuit for providing time signals, said time signals controlling said updating circuit.

32. The device of claim 31 in which the display further comprises a time display for selectively displaying one of a plurality of time symbols, each time symbol corresponding to a time of day, the time signals provided by the time-keeping circuit further selectively activating the time display to display the time symbol corresponding to the current time.

33. The device of claim 31 in which the time-keeping circuit is a watch.

34. The device of claim 31, further comprising an input circuit for setting the time-keeping circuit to the current time.

35. The device of claim 17, further comprising an input circuit for providing selection signals indicating calendar data selected by an operator and further comprising a selection circuit for selectively activating said display elements to display calendar data selected by the operator in response to the selection signals, each column displaying the same day of the week even when the calendar data being displayed is changed by said selection circuit.

* * * * *

US004540292C1

(12) REEXAMINATION CERTIFICATE (4725th)

United States Patent

Rubenstein et al.

(10) Number: US 4,540,292 C1

(45) Certificate Issued: Jan. 28, 2003

(54) ELECTRONIC CALENDAR DISPLAY

(75) Inventors: Charles P. Rubenstein, Massapequa, NY (US); Jeffrey S. Nevid, Bayside, NY (US); Spencer A. Rathus, Princeton, NJ (US)

(73) Assignee: Psytronics Associates, Princeton, NJ (US)

Reexamination Request:
No. 90/003,669, Dec. 23, 1994

Reexamination Certificate for:

| | |
|---|---|
| Patent No.: | **4,540,292** |
| Issued: | **Sep. 10, 1985** |
| Appl. No.: | **06/566,204** |
| Filed: | **Dec. 28, 1983** |

(51) Int. Cl.[7] ..... G04B 19/24; G04C 19/00

(52) U.S. Cl. ..... 368/29; 368/82

(58) Field of Search ..... 368/10, 28–31, 368/41–44, 82–84, 223, 239–242; 40/107–110, 446–448; 364/569, 7.5, 709, 710

(56) References Cited

U.S. PATENT DOCUMENTS

| | | | |
|---|---|---|---|
| 3,738,099 | A | 6/1973 | Tanaka |
| 3,792,541 | A | 2/1974 | Engle, Jr. |
| 3,797,222 | A | 3/1974 | Kato |
| 3,916,172 | A | 10/1975 | Engle, Jr. |
| 3,999,050 | A | 12/1976 | Pitroda |
| 4,023,344 | A | 5/1977 | Mukaiyama |
| 4,055,749 | A | 10/1977 | Kraushaar |
| 4,070,697 | A | 1/1978 | Miller et al. |
| 4,106,277 | A | 8/1978 | Garrison et al. |
| 4,117,542 | A | 9/1978 | Klausner et al. |
| 4,117,657 | A | 10/1978 | Shimizu |
| 4,130,987 | A | 12/1978 | Schickedanz |
| 4,147,022 | A | 4/1979 | Ichikawa |
| 4,148,180 | A | 4/1979 | Maezawa |
| 4,158,285 | A | 6/1979 | Heinsen et al. |
| 4,162,610 | A | 7/1979 | Levine |
| 4,170,105 | A | 10/1979 | Kashio |
| 4,175,372 | A | 11/1979 | Tamaru et al. |
| 4,178,750 | A | 12/1979 | Murakami et al. |
| 4,193,120 | A | 3/1980 | Yello |
| 4,193,255 | A | 3/1980 | Ebihara et al. |
| 4,205,516 | A | 6/1980 | Terao |
| 4,209,974 | A | 7/1980 | Noble |
| 4,212,159 | A | 7/1980 | Noble et al. |
| 4,216,649 | A | 8/1980 | Ichikawa et al. |
| 4,233,681 | A | 11/1980 | Murata |
| 4,247,927 | A | 1/1981 | Oooka et al. |
| 4,254,486 | A | 3/1981 | Masuda et al. |
| 4,254,487 | A | 3/1981 | Lee |
| 4,261,046 | A | 4/1981 | Ono et al. |
| 4,270,192 | A | 5/1981 | Kudo |

(List continued on next page.)

FOREIGN PATENT DOCUMENTS

| | | | |
|---|---|---|---|
| JP | 53-64071 | * | 6/1978 |
| JP | 53-90970 | | 8/1978 |
| JP | 53-139571 | * | 12/1978 |
| JP | 57-40682 | * | 3/1982 |

*Primary Examiner*—Vit W. Miska

(57) ABSTRACT

An electronic calendar display in which each column always corresponds to a particular day of the week is disclosed. Each display element in each column includes a group of display segments which are selectively activated to display a number corresponding to a day of the month. Seven display elements are used to form a row representing a week, and six such rows may be arranged to represent an entire month. In addition, twelve month displays may be arranged to represent a year. The circuitry which updates the display segments includes a look-up table stored in a read-only memory which indicates the display segments to be acrtivated for the current month and year. In the preferred embodiment, this circuitry also includes a microprocessor and the display includes alphanumeric display elements which can display a message. A keyboard or other interface permits an operator to enter the message. A watch is used to provide an indication of the current time and to signal when the display should be updated. In addition, the operator may push buttons to change the calendar data displayed.

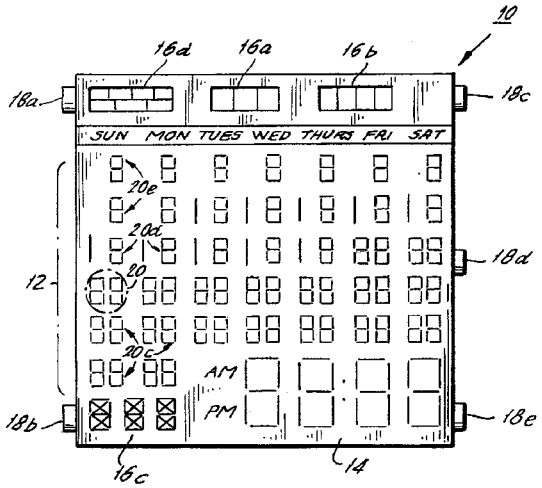

U.S. PATENT DOCUMENTS

| | | | |
|---|---|---|---|
| 4,270,193 | A | 5/1981 | Ichikawa |
| 4,274,146 | A | 6/1981 | Yanagawa |
| 4,285,483 | A | 8/1981 | Cipollone |
| 4,302,752 | A | 11/1981 | Weitzler |
| 4,303,995 | A | 12/1981 | Aizawa |
| 4,312,055 | A | 1/1982 | Noble |
| 4,353,178 | A | 10/1982 | Maezawa |
| 4,368,988 | A | 1/1983 | Tahara et al. |
| 4,376,567 | A | 3/1983 | Banda |
| 4,385,291 | A | 5/1983 | Piquet |
| 4,391,530 | A | 7/1983 | Wakabayashi et al. |
| 4,396,293 | A | 8/1983 | Mizoguchi |
| 4,443,851 | A | 4/1984 | Lin |
| 4,444,511 | A | 4/1984 | Ogihara et al. |

* cited by examiner

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–35 are cancelled.

* * * * *